US006336332B1

(12) United States Patent
Cohu

(10) Patent No.: US 6,336,332 B1
(45) Date of Patent: Jan. 8, 2002

(54) PRESSURE REGULATING DEVICE FOR A CRYOGENIC TANK AND PLANT FOR DELIVERING CORRESPONDING FLUID

(75) Inventor: Antoine Cohu, Versoud (FR)

(73) Assignee: L'Air Liquide, Societe Anonyme pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/589,519

(22) Filed: Jun. 8, 2000

(30) Foreign Application Priority Data

Jun. 8, 1999 (FR) ..... 99 07190

(51) Int. Cl.[7] ..... F17C 9/02
(52) U.S. Cl. ..... 62/50.2; 62/48.4
(58) Field of Search ..... 62/48.1, 48.4, 62/50.2

(56) References Cited

U.S. PATENT DOCUMENTS 2,309,813 A * 2/1943 Whiting ..... 62/48.1
2,443,724 A * 6/1948 Cibullka ..... 62/48.1
2,665,556 A * 1/1954 Otten ..... 62/50.2
3,861,161 A * 1/1975 Cooper ..... 62/48.1
4,608,831 A 9/1986 Gustafson
4,854,128 A 8/1989 Zeamer

FOREIGN PATENT DOCUMENTS

FR 1 527 346 11/1968

* cited by examiner

*Primary Examiner*—Ronald Capossela
(74) *Attorney, Agent, or Firm*—Young & Thompson

(57) ABSTRACT

This device comprises a closed heating chamber (36) extending through the wall (3, 4, 5) of the tank and connected to this wall, a feed pipe (22) suitable for feeding the heating chamber (36) with a heating fluid having a temperature above the temperature of the cryogenic fluid, and an exhaust pipe (23) intended for discharging the heating fluid, each of the pipes intended for discharging the heating fluid, each of the pipes (22, 23) passing through an outer wall (20) of the heating chamber (36). The device is particularly useful in the delivery of ultrapure helium.

12 Claims, 2 Drawing Sheets

PRESSURE REGULATING DEVICE FOR A CRYOGENIC TANK AND PLANT FOR DELIVERING CORRESPONDING FLUID

FIELD OF THE INVENTION

The present invention relates to a pressure-regulating device for a tank of a cryogenic fluid, especially a helium tank, which comprises a closed heating chamber extending through the wall of the tank and connected to this wall.

It furthermore relates to a plant for delivering fluid from a cryogenic tank.

The invention applies, for example, to the delivery of ultrapure helium for the microelectronics industry.

BACKGROUND OF THE INVENTION

Cryogenic tanks have a very efficient thermal insulation. When gas is withdrawn from such a tank, the pressure, which is typically a few bar relative, drops because the heat influx is too low to compensate for the loss of fluid. Consequently, when gas is withdrawn, the pressure in the tank may drop excessively with respect to the requirements of the user network.

In order to keep the pressure in the tank constant, heat has to be supplied to the tank during withdrawal.

For this purpose, pressure-regulating devices for cryogenic tanks are known which use an electrical resistor as heating element, in combination with electrical safety means should there be a power failure. However, the known solutions are expensive if the emergency electrical supply has to operate for a long period.

SUMMARY OF THE INVENTION

The object of the invention is to provide an inexpensive pressure-regulating device which can provide a cryogenic tank with heat over a long period. The invention must furthermore guarantee that the contents of the container are not contaminated, even in the case of ultrapure fluids.

For this purpose, the subject of the invention is a pressure-regulating device characterized in that it includes a feed pipe suitable for feeding the heating chamber with a heating fluid having a temperature above the temperature of the said cryogenic fluid, and an exhaust pipe intended for discharging the heating fluid, each of the said pipes passing through an outer wall of the heating chamber.

The device according to the invention may include one or more of the following characteristics taken by themselves or according to any of their technically possible combinations:

- the device includes a controlled valve inserted in the feed pipe and connected via its control part to a pipe for using the fluid in the tank so as to open the controlled valve when the pressure in the tank drops below a predetermined threshold;
- the device includes second heating means, especially electrical resistors;
- the second heating means are inserted into the heating chamber, preferably near the outlet of the feed pipe;
- an insulating sleeve is provided on the inner wall of the tank, around a mid-section of the heating chamber, dividing the heating chamber into an insulated outer region and an uninsulated inner region;
- the outlet of the feed pipe lies within the uninsulated region, near the inner end of the heating chamber;
- the inlet of the exhaust pipe lies within the uninsulated region, near the insulated region;

- the exhaust pipe is covered with thermal insulation means which extend from the outside of the heating chamber through its outer wall and approximately as far as the inlet of this pipe;
- the heating gas has, under its conditions of use, a dew point below the temperature of the cryogenic fluid contained in the tank;
- the cryogenic fluid and the heating gas consist of helium; and
- the pipes are composed of a material which is a poor thermal conductor, especially an epoxy resin.

The subject of the invention is also a plant for delivering a fluid, comprising a tank for this fluid, which is in cryogenic form, equipped with a heating device as defined above, a use pipe, connecting the tank to a use station, and a heating gas source connected via a feed pipe to the heating device.

BRIEF DESCRIPTION OF THE DRAWINGS

The invention will be more clearly understood on reading the description which follows, given solely by way of example and with reference to the drawings in which.

DETAILED DESCRIPTION OF THE INVENTION

Figure 1:
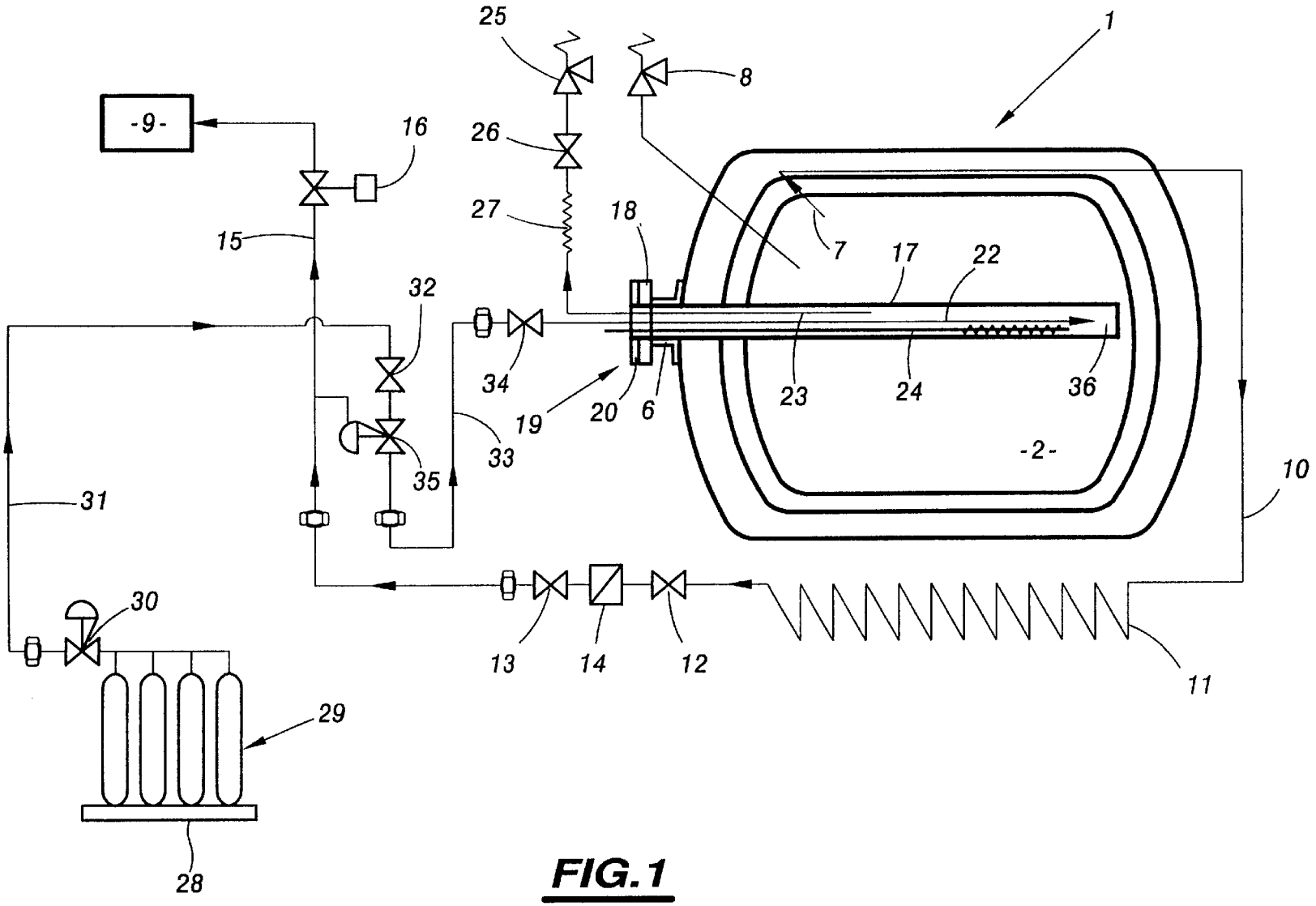
FIG. 1 is schematic view of a helium delivery plant according to the invention.

The cryogenic tank 1 contains helium 2 in the supercritical state, at a very low temperature, typically between 4 and 45 K. It is of a known type and is formed by an outer wall 3, an inner wall 4 and a central wall 5 which are spaced apart, the spaces being filled with a material which is a good thermal insulator and a vacuum being created therein. The central wall 5 additionally includes means which allow it to be cooled by the fluid leaving the tank during withdrawal.

The tank includes a neck 6 for the heating device, a withdrawal pipe 7 and a safety valve 8. The tank 1 is connected to a use station 9 via, in succession, the withdrawal pipe 7, an intermediate pipe 10, an atmospheric heater 11, two valves 12, 13 between which a filter 14 is provided, and a use pipe 15. The latter is equipped with a use valve 16 which controls the helium withdrawal. This valve has a construction such that, when there is a power failure, it is in the flow position.

A finger 17 extends through the neck 6 and the walls 3, 4, 5 of the tank 1. It is provided at its inlet with a flange 18 fastened to the inlet of the neck 6. Inserted into the finger 17 is a heating device 19 provided with a closure flange 20 which is removably fastened to the flange 18 by means of bolts 21. A feed pipe 22 and an exhaust pipe 23 extend through the flange 20, as does an electrical heating rod 24.

A discharge valve 25 is connected via an outlet valve 26 and a heater coil 27 to the exhaust pipe 23.

A stand 28 supports bottles 29 of heating helium at room temperature, the bottles being connected via a regulator 30 and a pipe 31 to a valve 32. Inserted into the pipe 33 which connects the valve 32 to a feed valve 34 of the feed pipe 22 is a controlled dome valve 35. Its dome is connected to the pipe 15 so that when the pressure in the pipe 15 falls below a certain threshold, the valve 35 opens, allowing heating gas to pass into the pipe 33.

Figure 2:
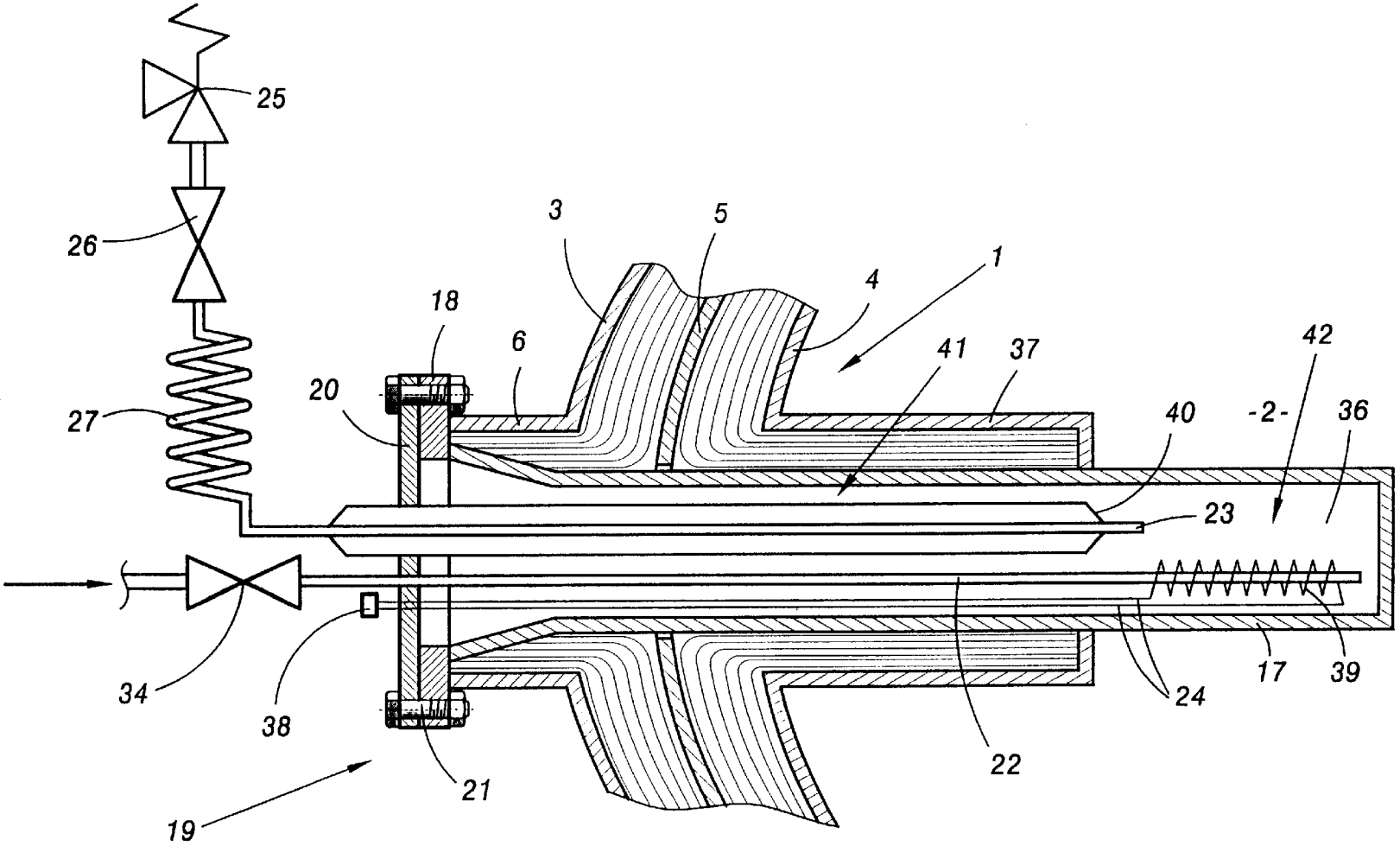
FIG. 2 is a longitudinal sectional view on a larger scale of the pressure-regulating device connected to the cryogenic tank.

FIG. 2 shows in more detail one embodiment of the device used for regulating the pressure.

The heating chamber 36 is bounded by the finger 17, the flange of the tank 18 and the closure flange 20 forming the outer wall. An insulating sleeve 37, which is connected to the inner wall 4 of the tank 1, surrounds part of the finger 17. The feed pipe 22, to which the feed valve 34 is connected, passes through the flange 20 and extends almost as far as the bottom of the heating chamber 36. The said pipe is preferably made of an epoxy resin. The heating rod 24, the electrical connection 38 of which is located outside the chamber 36, is placed inside this chamber, reaching almost as far as the bottom of the finger 17. Its resistor 39 is wound around the end part of the feed pipe 22.

The exhaust pipe 23 is surrounded by an evacuated tube 40, which tube extends from the outside of the heating chamber 36, through the flange 20, virtually as far as the end of the insulating sleeve 37. Likewise, the opening of the exhaust pipe 23 is placed approximately level with the end of the insulating sleeve 37.

Two regions in the heating chamber 36 may be distinguished: an insulated outer region 41 covered by the neck 6, the walls 3, 4, 5 and the insulating sleeve 37, and an uninsulated inner region 42.

The plant operates in the following manner:

When the pressure of the helium 2 in the tank 1 is high enough, within the limit permitted by the safety valve 8, the pressure in the pipe 15 is also high enough for the valve 35 to close the pipe 33. Consequently, no heating gas is introduced into the heating chamber 36. Heat influx is reduced by the low conduction of the materials, the thermal path extended by the insulation 37 and the helium-cooled central wall 5.

If gas is consumed at the use station 9, fluid is withdrawn from the tank 1. The gas is taken via the pipes 7 and 10 to the heater 11, where it is heated to room temperature, passes through the valves 12, 13 and the filter 14 and then enters the pipe 15.

Because of this withdrawal, the pressure drops in the tank 1. In normal operation, the electrical rod 24 is supplied by the electrical mains, under the control of pressure-controlled means (not shown). The inside of the heating chamber 36 is then heated by the resistor 39 of this rod when the pressure in the tank falls below a predetermined threshold.

If the resistor 39 does not operate, for example should there be a power failure, the pressure continues to drop so that the pressure also drops in the control dome of the valve 35. When the pressure falls below a predetermined threshold, the dome opens the valve 35, thereby allowing the heating gas to flow. Heating gas then escapes from the bottles 29 and, after expansion in the expander 30, flows into the pipe 31.

The gas flows through the valve 32 and the controlled valve 35 and flows through the pipe 33 and the feed valve 34 and then into the feed pipe 22, from where it reaches the heating chamber 36.

The heating gas then supplies heat in the section which is not covered by the insulating sleeve 37, through the wall of the finger 17, thereby heating the helium 2 contained in the cryogenic tank 1. This has the result of raising the pressure in the tank 1.

When, because of the continuous supply of the heating chamber 36 with heating gas, the pressure in the chamber rises above a certain threshold, the heating gas is discharged via the discharge pipe 23, the heater coil 27, the outlet valve 26 and the discharge valve 25.

When the pressure in the tank 1, and consequently in the pipe 15, has risen sufficiently, the dome of the valve 35 stops the flow of the heating gas into the pipe 33.

Thus, the heating is stopped and the pressure in the tank no longer rises, except because of the heat influx, which is very small.

Thus, should there be a power failure, the use of such a device heats the tank 1 in a simple, inexpensive and automatic manner. In order to maximize the heat delivered to the helium in the tank 1, the outlet of the feed pipe 22 and the inlet of the exhaust pipe 23 are far apart. For the same purpose, the feed pipe 22 is not provided with a thermal insulation, unlike the exhaust pipe 23.

What is claimed is:

1. A heating device to be mounted in a tank containing a cryogenic fluid under pressure to maintain the pressure therein, the device comprising an elongated closed heating chamber adapted to extend within the tank, a feed pipe opening into the heating chamber for supplying a heating fluid having a temperature above the storage temperature of cryogenic fluid, and an exhaust pipe for discharging the heating fluid from the chamber, each of said pipes passing through an end wall of the heating chamber.

2. The device of claim 1 including second heating means within the heating chamber.

3. The device of claim 2, wherein the second heating means are disposed near a discharge outlet of the feed pipe.

4. The device according to claim 1, wherein the exhaust pipe is covered with thermal insulation means which extend from the outside of the heating chamber through its outer wall and approximately as far as an inlet of said exhaust pipe.

5. The device according to claim 1, wherein the heating fluid has, under its conditions of use, a dew point below the temperature of the cryogenic fluid contained in the tank.

6. The device according to claim 5, wherein the cryogenic fluid and the heating fluid consist of helium.

7. The device according to claim 1, wherein the feed pipe and exhaust pipe are made of a material which is a poor thermal conductor.

8. The device according to claim 7, wherein the material is an epoxy resin.

9. A tank for containing a cryogenic fluid, compromising:

a plurality of concentric walls including at least an outer wall and an inner wall;

a heating device comprising an elongated closed heating chamber extending within said tank;

a feed pipe opening into the heating chamber for supplying a heating fluid having a temperature above the temperature of the cryogenic fluid;

an exhaust pipe for discharging the heating fluid from the heating chamber;

said feed pipe and said exhaust pipe passing through an end wall of the heating chamber; and an insulating sleeve provided on the inner wall of the tank around a mid-section of the heating chamber, dividing the heating chamber into an insulated outer region and an uninsulated inner region.

10. The tank according to claim 9, wherein the feed pipe has an outlet which lies within the uninsulated region, near an inner end of the heating chamber.

11. The tank according to claim 9, wherein the exhaust pipe has an inlet which lies within the uninsulated region, near the insulated region.

12. Plant for delivering a fluid comprising a tank for containing a cryogenic fluid, and equipped with a heating device according to claim 9, a use pipe connecting the tank to a use station, and a heating gas source connected via a supply pipe to the heating device.

* * * * *